United States Patent [19]

Onodera et al.

[11] 4,339,619

[45] Jul. 13, 1982

[54] SOLVENT DEWAXING WAXY HYDROCARBON OILS USING DEWAXING AID

[75] Inventors: Takashi Onodera, Urawa; Kikuji Komine, Tokorozawa; Fumio Ohashi; Tsutomo Naito, both of Ohi, all of Japan

[73] Assignee: Toa Nenryo Kogyo Kabushiki Kaisha, Tokyo, Japan

[21] Appl. No.: 180,106

[22] Filed: Aug. 21, 1980

Related U.S. Application Data

[60] Continuation of Ser. No. 35,474, May 3, 1979, abandoned, which is a division of Ser. No. 926,812, Jul. 21, 1978.

[30] Foreign Application Priority Data

Apr. 18, 1977 [JP] Japan ..... 52-44261

[51] Int. Cl.[3] ..... C07C 25/18

[52] U.S. Cl. ..... 570/183; 252/52 R; 208/33; 585/26

[58] Field of Search ..... 208/33; 585/26; 252/52 R; 570/183

[56] References Cited

U.S. PATENT DOCUMENTS

| | | | |
|---|---|---|---|
| 1,815,022 | 7/1931 | Davis | 252/52 R |
| 2,111,769 | 3/1938 | Graves | 87/9 |
| 2,128,109 | 8/1938 | Wiezevich | 87/9 |
| 2,246,311 | 6/1941 | Lieber et al. | 260/666 |
| 2,249,317 | 7/1941 | Lieber et al. | 260/505 |
| 2,353,053 | 7/1942 | Lieber et al. | 252/51 |
| 2,722,499 | 11/1955 | Weeks | 196/19 |
| 2,798,027 | 7/1957 | Cohen | 196/19 |
| 3,239,445 | 3/1966 | Leonard et al. | 208/33 |
| 3,458,430 | 7/1969 | Henselman et al. | 208/33 |
| 3,475,321 | 10/1969 | Henselman et al. | 208/33 |

FOREIGN PATENT DOCUMENTS

| | | |
|---|---|---|
| 45-4046361 | 12/1970 | Japan . |
| 1303126 | 1/1973 | United Kingdom . |

OTHER PUBLICATIONS

Journal of the Japan Pet. Ins., vol. 15, No. 2, p. 117 ff, (1972), "Studies on Correlation Between Comp. of Poor Pt. Depressant and Depressionability", Wakana et al.

*Primary Examiner*—Curtis R. Davis

*Attorney, Agent, or Firm*—Edward M. Corcoran; Joseph J. Allocca

[57] ABSTRACT

In a solvent dewaxing process wherein a waxy hydrocarbon oil is mixed with a dewaxing aid and dewaxing solvent and chilled to form a slurry comprising solid particles of wax and a mixture of dewaxed oil and solvent, the improvement which comprises using a polymeric dewaxing aid comprising a condensation product of naphthalene and chlorinated wax having an average molecular weight ranging from about 20,000 to 500,000 and a molecular weight distribution exceeding the range of from about 10,000 to 1,000,000.

1 Claim, No Drawings

SOLVENT DEWAXING WAXY HYDROCARBON OILS USING DEWAXING AID

This is a continuation, of application Ser. No. 035,474, filed May 3, 1979, now abandoned, which is a division of application Ser. No. 926,812, filed July 21, 1978.

BACKGROUND OF THE INVENTION

1. Field of the Invention

This invention relates to a process for solvent dewaxing waxy hydrocarbon oils using a dewaxing aid. More particularly, this invention relates to a solvent dewaxing process for waxy hydrocarbon oils using a naphthalene/chlorinated wax dewaxing aid having a high molecular weight and broad molecular weight distribution. Still more particularly, this invention relates to an improvement in a solvent dewaxing process wherein the improvement comprises using a polymeric dewaxing aid comprising a condensation product of naphthalene and chlorinated wax having an average molecular weight ranging from about 10,000 to 1,000,000 and a molecular weight distribution exceeding the range of from about 10,000 to 1,000,000.

2. Description of the Prior Art

Waxes in wax-containing hydrocarbon oils are removed therefrom by chilling the oil to precipitate out the wax and then separating the solid wax particles from the dewaxed oil by filtration of centrifugation. Industrial dewaxing processes include press dewaxing processes wherein the wax-containing oil, in the absence of solvent, is chilled to crystallize out the wax particles which are then pressed out by a filter. In general, only light hydrocarbon oil fractions (paraffinic fractions) obtained by vacuum distillation are treated by press dewaxing processes due to viscosity limitations. More widely used are solvent dewaxing processes wherein a waxy oil is mixed with a solvent and then chilled to precipitate the wax as tiny particles or crystals thereby forming a slurry of solid wax particles and a dewaxed oil containing dewaxing solvent. The slurry is then fed to a wax filter wherein the wax is removed from the dewaxed oil and dewaxing solvent. Solvent dewaxing processes are used for heavier oil fractions such as lubricating oil fractions and bright stocks. Typical dewaxing solvents include low boiling point or autorefrigerative hydrocarbons such as propane, propylene, butane, pentane, etc. ketones such as mixtures of acetone and MEK or MEK and MIBK as well as mixtures of ketones and aromatic hydrocarbons such as MEK/toluene and acetone/benzene.

One of the factors tending to limit the capacity of a solvent dewaxing plant is the rate of wax filtration from the dewaxed oil, which in turn is strongly influenced by the crystal structure of the precipitated wax. Although the crystal structure of the precipitated wax is influenced by various operation conditions in the dewaxing process, for any given feed it is most strongly influenced by the chilling conditions. The size and crystal structure of the precipitated wax, occlusion of oil in the wax crystal and the condition of the oil left in the crystal are extremely varied and depend on the wax composition and precipitation conditions. These conditions also affect the filtration rate of the dewaxed oil from the wax and the yield of dewaxed oil. In some cases, most notably when the waxy oil is a bright stock, the wax crystals are of an extremely fine size and not all are separated by filtration, but some leave the filter with the dewaxed oil component which creates an objectionable haze in the oil. Also, in some dewaxing processes too-rapid chilling of the waxy oil results in a so-called shock chilling effect yielding extremely fine sizes of wax crystals having poor filtration characteristics exhibited as a reduction of the filtration rate, decreased yield and increased pour point of the dewaxed oil. This phenomena often happens in autorefrigerant dewaxing processes wherein the waxy oil is chilled by the latent heat of vaporization of an autorefrigerant such as liquid propane.

One way of increasing the wax filtration rate is to add a dewaxing aid to the wax-containing oil. Well known in the art and dewaxing aids such as $\alpha$-olefin copolymers and mixtures of materials such as a mixture of an ethylenevinyl acetate copolymer and an unsaturated ester of an aliphatic alohol having from 2 to 20 carbon atoms with acrylic or methacrylic acid. However, these dewaxing acids are not terribly efficient, necessitating therefore relative high concentrations of same in the oil. This is especially true when a residual oil raffinate such as a bright stock is solvent dewaxed wherein a portion of the wax is precipitated as crystals so fine that they pass through filter cloths thereby creating a haze in the dewaxed oil which greatly reduces the commercial value of same.

It is also known in the art to use polymeric dewaxing aids comprising condensation products of chlorinated paraffin wax and naphthalene, commercially available as Paraflow, as set forth in U.S. Pat. No. 2,798,027, the disclosures of which are incorporated herein by reference. This reference also discloses using mixtures of dewaxing aids, such as Paraflow and an acrylic ester polymer such as Acryloid 150. It should be noted that the average molecular weight of Paraflow dewaxing aid is around 10,000. There is still room for improvement in this art area, especially when dewaxing relatively heavy lube oil stocks such as bright stocks and deasphalted resids, due to the problem of haze formation in the dewaxed oil resulting from fine wax crystals passing through the filter cloth in the wax filters.

It has now been found that in order for a dewaxing aid in a liquid mixture of dewaxing solvent and wax-containing oil to avoid plate-like, needle or amorphous crystals having relatively poor filtration characteristics and instead to form eutectic crystals with the wax that is precipitated via gradual cooling and which crystals are relatively uniform, spherical wax crystals having a size of from about 20 to about 100 microns which possess superior filtration characteristics resulting in faster wax filtration rates, it is necessary for the dewaxing aid to have a high average molecular weight and a wide molecular weight distribution.

SUMMARY OF THE INVENTION

Accordingly, therefore, it has now been found that an improvement results in processes for solvent dewaxing wax-containing hydrocarbon oils employing a polymeric dewaxing aid comprising a condensation product of naphthalene and chlorinated wax, if the chlorinated wax/naphthalene dewaxing aid has an average molecular weight ranging from about 10,000 to 1,000,000 and a molecular weight distribution exceeding the range of from about 10,000 to 1,000,000.

Thus, the naphthalene/chlorinated paraffin wax condensate that is used as the polymeric dewaxing aid of the instant invention is characterized by (1) a high molecular weight and (2) a broad molecular weight distribution. The first characteristic defining the condensate is that the average molecular weight is within the range of from about 10,000 to about 1,000,000 and preferably from about 20,000 to 500,000. It has been found that a condensate having an average molecular weight larger than about 1,000,000 or smaller than about 10,000 possesses inadequate dewaxing properties. Also, a condensate having an average molecular weight exceeding about 1,000,000 is particularly difficult to handle. The second characteristic of the condensate is that the molecular weight distribution range is not narrow but exceeds the range of from about 10,000 to about 1,000,000 and preferably lies within the range of from about 2,000 to about 3,000,000. Thus, the polymeric condensate constituting the dewaxing aid of the present invention has a much larger average molecular weight than known chlorinated paraffin wax/naphthalene condensates (which have an average molecular weight smaller than about 10,000). It is believed that by virtue of this very high average molecular weight, formation of eutectic crystals with the wax can be remarkably facilitated and crystals having a size and shape suitable for filtration can be formed and, therefore, such effects as an increase in the yield of dewaxed oil, improvement of the dewaxing rate and prevention of the occurrence of haze in the dewaxed oil can be attained. It should be noted that the molecular weight of the dewaxing aid was measured using Vapor Phase Osmometry for molecular weights of up to 50,000, while Membrane Osmometry was used to measure the molecular weights exceeding 50,000.

The chlorinated paraffin wax/naphthalene condensate of the present invention can be prepared according to the well-known Friedel-Crafts synthesis process described as follows. The paraffin was starting material is obtained by solvent-deoiling or sweating a slack wax formed by solvent dewaxing a wax-containing oil. The paraffin wax is mainly composed of linear paraffinic hydrocarbons and has an oil content lower than about 0.5 wt.% and a melting point ranging from about 120° to 180° F. (about 50° to 85° C.). When this paraffin wax is chlorinated continuously for about 24 hours at a temperature of about 80° C. in the presence of iodine or under sunlight by blowing chlorine according to known chlorination methods, chlorinated paraffin wax is obtained containing from about 1.3 to about 1.9 moles of chlorine per mole of the starting paraffin wax. The so-formed chlorinated paraffin wax along with naphthalene in an amount ranging from about 0.3 to 0.5 moles of naphthalene per mole of the chlorinated paraffin wax are charged into a reaction vessel. Powdered, anhydrous aluminum chloride is added as a catalyst. The reaction is carried out in a hydrocarbon solvent such as kerosene at a temperature ranging from room temperature to about 100° C., and preferably from about 70° to 90° C., for from about 6 to 24 hours. When the reaction is sufficiently advanced and a condensate having the desired high molecular weight is obtained, steam is blown into the reaction mixture to decompose the catalyst and stop the reaction. The reaction mixture is then washed with dilute hydrochloric acid and warm water, a water layer is separated and the catalyst is removed. The hydrocarbon solvent is removed by distillation. In order to obtain the desired broad molecular weight distribution ranges, one may use a method in which condensates differing in molecular weight distribution range are prepared separately and then mixed together.

The dewaxing aid will generally be added to the wax-containing oil feed in an amount ranging from about 0.01 to 1 wt.% and preferably from about 0.05 to 0.5 wt.%, based on the oil feed. It has been found that if the amount of dewaxing aid added is less than about 0.01 wt.%, unsatisfactory dewaxing results and, conversely, if the amount of dewaxing aid added to the oil is increased beyond about 1 wt.%, the dewaxing rate is reduced and the process becomes economically disadvantageous.

As hereinbefore mentioned, supra, use of the dewaxing aid of the present invention produces beneficial results in dewaxing operations as reflected in faster filtration rates, to an extent not heretofore obtained with this type of dewaxing aid. However, the filter rate can even be further improved if the dewaxing aid of this invention is used in combination with an acrylic ester polymer such as those produced from unsaturated esters of acrylic acid and/or methacrylic acid with at least one aliphatic alcohol having from 2 to 20 carbon atoms. These acrylic ester polymers have average molecular weights ranging from about 50,000 to about 3,000,000. Such polymers are well-known in the art and are formed by polymerizing at least one monomer formed by esterifying at least one aliphatic alcohol having from 2 to 20 carbon atoms with acrylic acid and/or methacrylic acid. Decyl alcohol, lauryl alcohol, myristyl alcohol and stearyl alcohol are preferably employed as the aliphatic alcohol. At least one aliphatic alcohol is esterified with acrylic acid, methacrylic acid or a mixture thereof, and the resulting ester is polymerized. Alternatively, esters of at least two aliphatic alcohols may be prepared separately and mixed together, followed by polymerizing the mixture. Of this mode, a preferred copolymer is a copolymer of lauryl methacrylate with a small quantity of an ester of at least one aliphatic alcohol having from 2 to 20 carbon atoms with methacrylic acid or acrylic acid.

This type of polymer has a molecular weight of from about 50,000 to 300,000 and more preferably from about 80,000 to 250,000. Preparation of these polymers is well-known in the art. Thus, a methacrylic ester monomer is prepared by direct esterification of an aliphatic alcohol with methacrylic acid or via ester exchange of methyl methacrylate with a higher aliphatic alcohol. Acrylic acid esters can also be prepared according to this method. The unsaturated ester monomer is then charged into a reaction vessel and polymerized in the presence of a peroxide catalyst at atmospheric pressure and a temperature ranging from about 90° to 100° C. for a period of time varying from 30 minutes to 4 hours. However, suitable acrylic ester polymers are commercially available such as Acryloid 150 (Rohm & Haas) or Aclube 102 (Sanyo Kasei). It should be noted that use of the acrylic ester polymer alone produce small improvement in dewaxing results.

It the naphthalene/chlorinated wax condensate of this invention is used with such an acrylic ester polymer, the weight ratio of condensate to ester will range from about 95/5 to 5/95 and preferably from about 40/60 to 60/40.

In practicing this invention, the dewaxing aid whether it is entirely the polymeric condensate of this invention or a mixture of said condensate and acrylic ester monomer, will be dissolved and dispersed in a mineral oil or the like so that the concentration of dewaxing aid is about from 30 to 50 wt.%. It is preferred that the dewaxing aid be used in the form of a solution having a viscosity ranging from about 50 to 800 centistokes at 98.5° C. The dewaxing aid will be added to the wax-containing oil feed in an amount ranging from about 0.01 to 1 wt.% and preferably from about 0.05 to 0.5 wt.%, based on the oil feed. It has been found that no substantial improvement in dewaxing performance will be realized if less than 0.01 wt.% of dewaxing aid is used. As hereinbefore stated, supra, it has been found that if the amount of dewaxing aid used is more than about 1 wt.%, the dewaxing rate is reduced and the process becomes disadvantageous from an economical viewpoint.

It is also noteworthy to mention that the dewaxing aid of this invention can be separated and recovered from the slack wax produced in the dewaxing operation, by vacuum distilling the slack wax under conditions disclosed in copending application No. 926,859 July 21, 1978 and the recovered dewaxing aid recycled repeatedly back into the dewaxing operation.

Any waxy petroleum oil stock or distillate fraction thereof may be dewaxed employing the dewaxing aid of this invention. Illustrative but non-limiting examples of such stocks are (a) distillate fractions that have a boiling range within the broad range of from about 500° to 1300° F., with preferred stocks including lubricating oil and specialty oil fractions boiling within the range of from between about 550° and 1200° F., and (b) bright stocks and deasphalted resids having an initial boiling point above about 800° F. Additionally, any of these feeds may be hydrocracked prior to distilling, or deasphalting. These may come from any source such as paraffinic crudes obtained from Armaco, Kuwait, Panhandle, North Louisiana, etc., naphthenic crudes, such as Tia Juana, coastal crudes, etc., as well as the relatively heavy feedstocks such as bright stocks having a boiling range of 1050+° F. and synthetic feedstocks derived from athabasca tar sands or coal, etc. This invention has been found to be particularly suited for dewaxing heavier feedstocks such as bright stocks and deasphalted resids.

The dewaxing solvent that is used in the present invention is not particularly critical. Namely, any of solvents having a selective dissolving property to the oil component of a wax-containing oil at a dewaxing low temperature can be used. For example, there may be used at least one member selected from linear hydrocarbons having 2 to 10 carbon atoms in the molecule, such as ethane, propane, butane, pentane, hexane, octane, ethylene, propylene, butylene, pentene, hexene and octene, or a mixture of at least one member selected from ketones such as acetone, dimethyl ketone, methylethyl ketone, methylpropyl ketone and methylisobutyl ketone with at least one member selected from aromatic hydrocarbons such as benzene and toluene, e.g., methylethyl ketone/toluene or methylisobutyl ketone/toluene. Further, N-alkylpyrrolidones such as N-methylpyrrolidone and N-ethylpyrrolidone may be used as the dewaxing solvent. Still further, an autorefrigerative mixed solvent such as a mixture of a linear hydrocarbon such as mentioned above with a ketone such as acetone can be used as the dewaxing solvent. Solvents preferred for practicing the process of the present invention include propane, other autorefrigerative solvents, and a mixture of a ketone and an aromatic hydrocarbon.

PREFERRED EMBODIMENT

In a preferred embodiment of the process of this invention, a solution of dewaxing aid comprising the polymeric chlorinated wax/naphthalene condensate of this invention either alone or mixed with an acrylic ester is mixed into a wax-containing oil and the mixture then introduced into a chilling zone along with dewaxing solvent wherein the entire mixture is chilled to a temperature necessary to yield the desired pour point for the resulting dewaxed oil. The chilling produces a slurry comprising dewaxed oil and solvent along with solid particles of wax which contain a dewaxing aid. This slurry is then sent to a wax filter to separate the dewaxed oil and solvent from the wax particles. The dewaxing temperature varies depending on the feed and conditions, but in general, the dewaxing temperature will range from about 0° to −50° C. In the case where a dewaxing solvent comprises a mixture of ketone/aromatic hydrocarbon, such as methylethyl ketone/toluene, the dewaxing temperature will range from about −10° to about −30° C. Where propane is used as a dewaxing solvent, the dewaxing temperature will generally be from about −20° to −40° C. Preferred dewaxing solvents used in the process of the instant invention include propane, other autorefrigerative solvents and a mixture of a ketone and an aromatic hydrocarbon. The ratio of solvent to waxy oil will generally range from about 0.5 to 10 and preferably from about 2 to 7, by volume. The optimum amount of dewaxing solvent employed is of course determined by the wax content of the oil, viscosity, pretreatment and dewaxing conditions. Slack wax recovered from the wax filters and containing the dewaxing aid may then be sent to a vacuum distillation zone, to separate most of the wax from the dewaxing aid and the dewaxing aid recovered therefrom as part of the wax bottoms produced in said distillation zone which is disclosed in copending application No. 926,859 July 21, 1978. The dewaxing aid may then be sent to storage and/or recycled back into the dewaxing operation.

The invention will be more apparent from the Examples set forth below.

EXAMPLE 1

A raffinate obtained by extracting a lubricating oil fraction with phenol [having a wax content of 15.7 wt.%, a specific gravity, 15/4° C., of 0.8830, a viscosity of 7.869 cst (as measured at 98.9° C.) and a viscosity index of 106.9] was charged into an autoclave along with dewaxing aid $A_3$ or $A_3/B_1$ shown in Table 1 and propane solvent in an amount 4 times the amount of the wax-containing oil by volume. The mixture was heated at 70° C. to form a homogeneous solution of the contents, and the solution was externally chilled under agitation at a chilling rate of 2° C./minute to 10° C. Then, the propane solvent was evaporated and the mixture was chilled to −40° C. at a chilling rate of 2° C./minute by the latent heat of evaporation of the propane. After the chilling operation, the dewaxed oil-solvent/wax slurry was fed to a wax filter wherein filtration was conducted for 40 seconds at a filtration pressure difference of 500 mm Hg, and the filtration rate was determined. The obtained dewaxing effect is shown in Table 1.

The dewaxing effects obtained when no dewaxing aid was added or a dewaxing aid $A_1$, $A_2$ or $A_1/B_1$ not falling within the scope of the present invention are also shown in Table 1, for comparison.

TABLE 1

| Composition of Dewaxing Aid | |
|---|---|
| Component A: | polyalkyl naphthalene (paraffin wax/naphthalene condensate) |
| $A_1$: | commercially available pour point depressant (Paraflow 149; average molecular weight = 3000; molecular weight distribution of 800 to 100,000) |
| $A_2$: | paraffin wax/naphthalene condensate having a melting point of 125° F. (about 52° C.) (average molecular weight = 2000; molecular weight distribution of 500 to 100,000) |
| $A_3$: | paraffin wax/naphthalene condensate having a melting point of 125° F. (about 52° C.) (average molecular weight = 100,000; molecular weight distribution of 10,000 to 2,000,000) |
| Component B: | polyalkyl methacrylate |
| $B_1$: | alkyl group composition of 34 wt. % of $C_{12}$, 22 wt. % of $C_{14}$, 34 wt. % of $C_{16}$ and 10 wt. % of $C_{18}$; average molecular weight of 280,000 and molecular weight distribution of 10,000 to 1,000,000. |

Note: the molecular weight was determined by vapor Phase Osmometry in case of polymeric substances having a molecular weight of up to 50,000 and according to Membrane Osmometry in case of polymeric substances having a molecular weight exceeding 50,000.)

| | Dewaxing Results | | | | | |
|---|---|---|---|---|---|---|
| | Run 1 | Run 2 | Run 3 | Run 4 (present invention) | Run 5 | Run 6 (present invention) |
| Kind of dewaxing aid | not added | $A_1$ | $A_2$ | $A_3$ | $A_1/B_1$ | $A_3/B_1$ |
| Ratio of dewaxing aid (%) | — | 100 | 100 | 100 | 50/50 | 50/50 |
| Amount added (wt. % based on feed oil) | — | 0.2 | 0.2 | 0.08 | 0.2 | 0.08 |
| Filtration rate (gallons/ft$^2$/hr. | 1.6 | 8.8 | 7.6 | 10.1 | 17.8 | 31.0 |
| Relative filtration rate | 18 | 100 | 86 | 115 | 202 | 352 |
| Yield (wt. %) of dewaxed oil | 65 | 79 | 78 | 81 | 80 | 83 |
| Oil content (wt. %) in slack wax | 56 | 29 | 32 | 20 | 25 | 15 |
| Occurrence of haze in dewaxed oil (after 48 hours) | not observed | not observed | not observed | not observed | not observed | not observed |

EXAMPLE 2

A residual oil raffinate [having a wax content of 20.8 wt.%, a specific gravity, 15/4° C., of 0.9006, a viscosity of 28.5 cst ( as measured at 98.9° C.) and a viscosity index of 103] was solvent-dewaxed by using propane under the same conditions and in the same manner as described in Example 1. For comparison, the dewaxing was carried out without using a dewaxing aid or by using the commercially available dewaxing aid $A_1$, $A_2$ or $A_1/B_1$. Obtained results are shown in Table 2.

EXAMPLE 3

A dewaxing aid $A_4$ (paraffin wax (melt. Pt.:175° F.)/naphthalene condensate; average molecular weight=200,000; molecular weight distribution range of from 10,000 to 3,000,000) was added to a residual oil raffinate (same as used in Example 2) as the feedstock singly or in combination with the filter aid $B_1$ (polyalkyl methacrylate) shown in Table 1, and the propane dewaxing was carried out in the same manner as described in Example 1. Obtained results are shown in Table 3.

For comparison, the propane dewaxing was carried out without addition of any dewaxing aid or by using

TABLE 2

| | Dewaxing Results | | | | | |
|---|---|---|---|---|---|---|
| | Run 1 | Run 2 | Run 3 | Run 4 (present invention) | Run 5 | Run 6 (present invention) |
| Kind of dewaxing aid | not added | $A_1$ | $A_2$ | $A_3$ | $A_1/B_1$ | $A_3/B_1$ |
| Ratio (%) of dewaxing aid | — | 100 | 100 | 100 | 50/50 | 50/50 |
| Amount added (wt. %) | — | 0.2 | 0.2 | 0.08 | 0.2 | 0.08 |
| Filtration rate (gallons/ft$^2$/hr.) | 0.9 | 3.0 | 2.8 | 4.0 | 4.5 | 12.8 |
| Relative filtration rate | 30 | 100 | 93 | 133 | 150 | 427 |
| Yield (wt. %) of dewaxed oil | 54 | 75 | 74 | 75 | 77 | 78 |
| Oil content (wt. %) in slack wax | 57 | 21 | 25 | 20 | 15 | 10 |
| Occurrence of haze in dewaxed oil (after 48 hours) | observed | observed | observed | not observed | observed | not observed |

$A_1$ or $A_1/B_1$. Obtained results are also shown in Table 3.

TABLE 3

| | Dewaxing Results | | | | |
|---|---|---|---|---|---|
| | Run 1 | Run 2 | Run 3 (present invention) | Run 4 | Run 5 (present invention) |
| Kind of dewaxing aid | not | $A_1$ | $A_4$ | $A_1/B_1$ | $A_4/B_1$ |
| Ratio (%) of dewaxing aid | — | 100 | 100 | 50/50 | 50/50 |
| Amount added (wt. %) | — | 0.2 | 0.08 | 0.2 | 0.08 |
| Filtration rate (gallons/ft$^2$/hr) | 0.9 | 3.0 | 5.5 | 4.5 | 15.2 |
| Relative filtration rate | 30 | 100 | 183 | 150 | 506 |
| Yield (wt. %) of dewaxed oil | 54 | 75 | 76 | 77 | 79 |
| Oil content (wt. %) in slack wax | 57 | 21 | 19 | 15 | 6 |
| Occurrence of haze in dewaxed oil (after 48 hours) | observed | observed | not observed | observed | not observed |

EXAMPLE 4

A 50:50 mixed solvent of methylethyl ketone and toluene and the dewaxing aid $A_4$ shown in Example 3 were added to the same residual oil raffinate as used in Example 2, and the dewaxing was carried out to obtain results shown in Table 4.

For comparison, the dewaxing was carried out without addition of any dewaxing aid or by using the dewaxing aid $A_1$. Obtained results are also shown in Table 4.

TABLE 4

| Dewaxing Results | Run 1 | Run 2 | Run 3 (present invention) |
|---|---|---|---|
| Kind of dewaxing aid | not added | $A_1$ | $A_4$ |
| Amount added (wt. %) | — | 0.2 | 0.06 |
| Filtration rate (gallons/ft$^2$/hr) | 1.3 | 3.3 | 6.2 |
| Relative filtration rate | 39 | 100 | 188 |
| Yield (wt. %) of dewaxed oil | 50 | 71 | 75 |
| Oil content (wt. %) in slack wax | 60 | 32 | 21 |
| Occurrence of haze in dewaxed oil (after 48 hours) | observed | observed | not observed |

What is claimed is:

1. An improved chlorinated wax/naphthalene condensation product dewaxing aid wherein the improvement comprises an average molecular weight of between about 20,000 to 500,000 and a molecular weight distribution exceeding the range of from 10,000 to 1,000,000, but falling within the range of between about 2,000 to 3,000,000.

* * * * *